United States Patent [19]

Schmidt

[11] Patent Number: 4,522,518

[45] Date of Patent: Jun. 11, 1985

[54] CHARACTER DATA INPUT KEYBOARD ARRANGEMENT HAVING CENTRAL MATRIX OF KEYS

[76] Inventor: John R. Schmidt, 3239 Bishop St., Cincinnati, Ohio 45220

[21] Appl. No.: 511,741

[22] Filed: Jul. 7, 1983

[51] Int. Cl.[3] ..... B41J 5/10

[52] U.S. Cl. ..... 400/486; 400/489; 340/365 R

[58] Field of Search ..... 400/489, 486, 485, 484; D18/1; 340/365 VL, 365 R

[56] References Cited

U.S. PATENT DOCUMENTS

| | | | |
|---|---|---|---|
| 207,559 | 8/1878 | Sholes | 400/332.2 |
| D. 250,022 | 10/1978 | Pycha | D14/100 |
| 1,336,122 | 4/1920 | Banaji | 400/486 |
| 1,506,426 | 8/1924 | Hoke | 400/486 |
| 1,652,464 | 12/1927 | Tyberg | 400/489 |
| 1,678,334 | 7/1928 | Fischer | 400/489 |
| 2,522,119 | 9/1950 | Kaelin | 340/365 R |
| 2,641,320 | 6/1953 | Johnson | 400/489 |
| 3,225,883 | 12/1965 | Ayres | 340/365 R |
| 3,305,062 | 2/1967 | Kittredge | 400/86 |
| 3,523,184 | 8/1970 | Vogel | 400/485 |
| 3,558,820 | 1/1971 | Eberle et al. | 340/365 R |
| 3,646,551 | 2/1972 | Bretti et al. | 340/365 R |
| 3,698,533 | 10/1972 | Dodds | 400/486 |
| 3,825,101 | 7/1974 | Wineman | 400/473 |
| 3,945,482 | 3/1976 | Einbinder | 400/486 |
| 3,970,185 | 7/1976 | Shelton | 400/486 |
| 4,121,048 | 10/1978 | Dev Choudhury | 400/486 |
| 4,124,843 | 11/1978 | Bramsen et al. | 340/365 R |
| 4,141,001 | 2/1979 | Suzuki et al. | 340/365 R |
| 4,244,659 | 1/1981 | Malt | 400/489 |
| 4,336,530 | 6/1982 | Koike et al. | 340/365 VL |
| 4,378,553 | 3/1983 | McCall | 340/365 R |

FOREIGN PATENT DOCUMENTS

| | | | |
|---|---|---|---|
| 238736 | 2/1965 | Austria | 400/486 |
| 2807061 | 8/1979 | Fed. Rep. of Germany | 340/365 R |
| 2041295 | 1/1979 | United Kingdom | 340/365 R |

OTHER PUBLICATIONS

Bigbie et al., "Programmable Key . . . Device", IBM Technical Disclosure Bulletin, vol. 21, No. 2, pp. 442–444, 7/78.

Selected pages of "Industrial Design", Jan./Feb. 1974.

Stuckert, 8–71, IBM Technical Disclosures Bulletin 14:03, p. 952.

Runyon, 11–72, Electronic Design 23:09, p. 55.

Emmons et al., 4–80, IBM Technical Disclosures Bulletin 22:11, p. 5084.

Montgomery, 3–82, Computer 15:03, p. 11.

Norman and Fisher, 10–82, Human Factors 24:05, p. 509.

*Primary Examiner*—William Pieprz

*Attorney, Agent, or Firm*—David E. Schmit

[57] ABSTRACT

A manual data entry keyboard, having left hand and right hand clusters of keys, is separated medially by an interposed, auxilliary matrix of keys comprising an [m×n] array of keys, where m and n are integers—m at least 4, n at least 1. In one embodiment the matrix includes a [5×2] array of keys which serve as a numeric keypad, accessed by the index fingers and thumbs, obsoleting the [1×10] array of number keys commonly included with the QWERTY cluster in existing English language keyboard arrangements. Top row accessory characters may be entered without the shift and are grouped in clusters in the top row and positioned to reflect the order of entry of elements of these groups in the usual flow of data. Punctuation keys are clustered in the right hand area of the keyboard, and except for the period and comma, are readily accessed by the little finger. Columns of keys, additional to the [5×2] keypad may be included in the keyboard, either or both medially and/or laterally to the two columns of the [5×2] array. Such added columns may serve as cursor control and editing keys, arithmetic operator keys, numeric punctuation keys, etc. Numeric entry is facilitated in arrangements that provide the [0] and [1] keys in the bottom row to be served by the thumbs while all fingers maintain home position on the keyboard.

35 Claims, 8 Drawing Figures

CHARACTER DATA INPUT KEYBOARD ARRANGEMENT HAVING CENTRAL MATRIX OF KEYS

BACKGROUND OF THE INVENTION

1. Field of the Invention

This invention applies generally to data input keyboards, and more particularly to any character data input keyboard which purpose is to enable two-handed operation on a plurality of keys, clustered and ordered so that operation is possible without the aid of continuous operator vision directed at the keyboard. The present invention is a keyboard arrangement especially suited for facile, rapid entry of character data. It is an arrangement of keys comprising a central matrix of keys located between divided clusters of keys, the central matrix readily accessable by medial movement of the index fingers and thumbs from resting positions in the divided clusters. The central matrix of keys has columns of four or more keys and may include numeric keys and/or keys of numeric operators, punctuation and screen editing at a video display terminal.

2. Ergonomic considerations

Medical theory, presented in HUMAN NEUROANATOMY (sixth edition) by R. C. Truex and M. B. Carpenter, suggests that the human brain evolved from less specialized forms which in the earliest stages were characterized by a cephalic enlargement of a single neural tube. This singularity at the top eventually gave way to a bifurcation of neuroanatomy which has resulted in functionally distinct right and left hemispheres of cerebral and cerebellar cortex.

Two distinct systems of neural control mediate motor (muscular) function. The more primitive system, called the extrapyramidal system, is functional in all vertebrates of the phylogenetic tree. In the human is the highest development of the pyramidal system, which functions in superposition to the more primitive but still importantly existent extrapyramidal system, the latter mediating basic reflexes and gross movements. Skilled volitional movements originate in giant pyramidal cells of Betz in the so called motor area (Brodmann's area 4) on the contralateral side of the cerebral cortex, and are conditioned by impulses from contralateral and ipselateral cerebellum.

Decisions which initiate fine motions in the hand, such as keystrokes on a character data input keyboard, must be followed by assignment to either the right or left precentral cortical area of the brain for effecting a decision. From there impulses are relayed, via corticofugal fibers of the pyramidal motor system, to the neuromuscular junctions in the contralateral hand that effect an appropriate keystroke, the elemental quantum of keyboard activity.

Because of this structural, binary separation of pyramidal neuromuscular function, decisions precedent to such function could be expedited by more clearly distinguishing, in the field of sensory input to the brain, the operative domain for the digits of each hand. This is the basis for one important feature of the present invention: that the keyboard be divided into clearly defined left and right keyboard areas, such that the human operator, with sternum aligned in the vertical plane bisecting the line connecting the epicenters of the divided cluster of keys, may symmetrically access keys located in the partition dividing the separated clusters.

As a result of greater use of the medial two digits—thumb and index finger—in the course of living, these are stronger than the lateral digits, namely: middle finger, ring finger, and little finger. Within the precentral motor area of the human cerebral cortex, a greater number of pyramidal neuro-effector cells are devoted to control of the thumb than exist for control of any of the fingers. In this regard the thumb is the most "intelligent" of the hand's digits.

The index finger, stronger than any of the other fingers, and the little finger are equal in the amount of neural representation in the motor areas. Neural control, mobility, and endurance are three parameters applicable to the function of character data entry. The middle finger and ring finger are least capable in light of these parameters, and each serve the minimum 4 keys on the conventional alphanumeric keyboard depicted in FIG. 1, the basis for which is commonly called the "Sholes cluster", or "QWERTY cluster". In usual practice, the index finger serves 8 keys, the little finger serves as many as 12 keys, while both thumbs serve only one key.

It is apparent that conventional, two-hand, alphanumeric keyboard entry underutilizes the index fingers and thumbs. Furthermore, as need increases for larger character sets and function keys, additional keys are placed lateral to the basic Sholes cluster. The result is that the little finger is overutilized and commonly pulls the hand away from the "Home" position on the keyboard when accessing one of the more lateral keys.

For numeric entry, three arrangements of ten keys are common:

(1) 1 row of 10 numbers in 10 columns: [1×10]

(2) 3 rows of 9 numbers in 3 columns and a tenth key adjacent: [3×3+1]

(3) 5 rows of 10 keys in 2 columns: [5×2].

Other variations, such as [2×5], [4×2+2], [10×1], etc. have not commonly been applied to the ordering of keys on a numeric keypad. In general, the third numeric arrangement listed above allows for a binary separation of keys, aligned with the division of the human cortex which effects operation on the keys.

Early in man's evolution arose the capacity to point, coupled with use of the index finger. As it is the index finger which naturally is used by the human to point in space, so is it proper to consider this human capacity in conjunction with direction of cursor movement at the video display control keyboard.

It is also well established that the index finger is favored by the human when a keyboard is accessed by only one digit. Consequently, a cluster of keys accessible to one-digit operation by the index finger, if centered, can be accessed equally well by right-handers and left-handers.

Since the majority of keyboard operators are right-handed, meaning that the left cerebral cortex is "dominant", a variation of the present invention makes use of the differential specialization of function that applies to the bipolarity of human neuro-cortical function. The left cortical hemisphere is more active in language and numeric processes while the right cortical hemisphere is more active in spatial relations. Specific application of this concept will be discussed hereinafter.

3. Description of the Prior Art

U.S. Pat. No. 207,559 (issued Aug. 27, 1878) to C. L. Sholes is widely credited as the forebearer of the existing conventional alphanumeric keyboard arrangement. Within the 50 year period in which Sholes created and, in conjunction with Remington, established this standard, many other alternatives were proffered from both sides of the Atlantic. In 1864, Mitterhofer in Austria and Pratta in Britian obtained patents for typewriters with keyboards that were split into right and left keyboard areas, such that the operative domain for each hand was demarcated by a middle region of no keys in the case of the latter and nonalphanumeric keys in the former.

In light of the standardization of the alphanumeric keyboard, proposed alterations throughout the past century have met with little commercial success. For example, several patents have proffered a supposed more optimal arrangement of the alphanumeric keyboard. Dvorak, in U.S. Pat. No. 2,040,248 (1937), focused on a single cluster arrangement of the letter keys while not challenging the [1×10] arrangement of the numeric keys.

U.S. Pat. No. 3,225,883 refers to a nonconventional alphanumeric keyboard in which a central cluster of 6 numeric keys, arranged in two columns of three keys, serve entry of the 10 numbers. In this patent, several letter keys also occupy the horizontally central keyboard region.

Austrian Pat. No. 238736 depicts a nonconventional keyboard in which a [5×2] numeric keypad is installed, off-center, in the medial area of a divided keyboard comprising 6 rows of alphanumeric and accessory keys. There is no spacebar in the bottom row. The numeric keypad shares the middle region of the keyboard with a set of sundry keys for puncuation, umlauted letters, and other keytypes, not so ordered as to be readily applicable to the conventional keyboard arrangement. The positioning, in this invention, of the numeric keys in an alphanumeric cluster is similar to the positioning of the number keys in a keyboard manufactured by MICRO SWITCH, as shown in Electronic Design 23:09 p55, 1972. Numeric entry there may require simultaneous depression of a Shift key, illustrating an embedded numeric keypad.

U.S. Pat. No. 3,305,062 (issued Feb. 21, 1967) to E. D. Kittredge, shows two separate fields of 25 keys, each a mirror image of the other. The middle region is not utilized.

U.S. Pat. No. 3,558,820 demonstrates centering of number keys in the middle region of a non-divided, unconventional keyboard. However, the numeric keypad comprises two redundant sets of 10 numbers in [4×5] configuration having no familiar intra-columnar ordering of keys. Sharing the middle region of the keyboard is a set of punctuation keys placed beneath the numeric keypad.

U.S. Pat. No. 3,698,532 shows a separation of a non-Sholes alphanumeric keyboard, retaining the [1×10] arrangement of the number keys.

U.S. Pat. No. 3,825,101 involves the location of a [3×3+1] numeric keypad in a plane several inches above the plane of a conventional alphanumeric keyboard.

U.S. Pat. No. 3,945,482 utilizes separation of the alphanumeric keyboard so as to better utilize the medial digits. The conventional [1×10] numeric arrangement is retained. The index fingers each access 2 more keys while each thumb serves 3 more keys than in the conventional keyboard arrangement.

Commensurate with the development of computer-related alphanumeric keyboards arose the design concept of supplementing the conventional typewriter keyboard with an auxilliary, calculator-type keypad. The [5×2] and [3×3+1] are two common means of arranging ten numbers in this application.

U.S. Pat. No. Des. 249,513 demonstrates the [5×2] arrangement while the [3×3+1] arrangement is evident in U.S. Pat. No. Des. 261,273. In both cases, the calculator-type numeric entry keypad is located laterally and removed from the conventional alphanumeric keyboard cluster. U.S. Pat. No. Des. 250,022 pictures an arrangement of keys incorporating all three instances of common numeric keypad arrangements. A [5×2] numeric keypad is located on the left side of and separate from the five-row cluster of the conventional alphanumeric keyboard. It may serve as ten function keys, requiring single-digit entry of the left hand, in lateral excursion from the conventional cluster. On the right of the conventional cluster is a [3×3+1] numeric entry keypad, readily accessed by the right index finger in lateral excursion from its Home position in the conventional cluster. In the top row of this keyboard is the conventional [1×10] array of number keys.

U.K. Pat. No. 2,041,295 demonstrates a separation of the alphanumeric cluster into right-hand and left-hand clusters, in the form of U.S. Pat. No. 3,698,532. In this patent, 4 rows comprise the alphanumeric cluster that includes the top row [1×10] numeric arrangement. Here the middle is augmented by four additional keys in a [2×2] array served equally by the thumbs and index fingers.

More recently, the Maltron keyboard arrangement, U.S. Pat. No. 4,244,659, is of the form of Einbinder's U.S. Pat. No. 3,945,482, discussed above, providing separation of the alphanumeric cluster and ten keys centered in the keyboard, though not in a regular array, and all accessed by the thumbs.

U.S. Pat. No. Des. 250,022 is currently implemented approximately in the IBM Personal Computer keyboard. As is commonly found in video display computer terminal keyboards, clusters of keys for special function are located lateral to the conventional alphanumeric cluster. For example, the keyboard for certain microcomputers is expanded to greater horizontal dimensions in accomodating separate clusters of keys for special function, calculator type numeric entry, cursor control, and other editing functions.

In the IBM PC keyboard, two of these functions—cursor control and calculator-type numeric entry—are combined in a single keypad requiring the toggling of an additional key for selecting one of the two functions. Most significant is the use of 30 numeric designated keys to serve three types of functions that, in the present invention requires only 10 keys.

SUMMARY OF THE INVENTION

In contrast to previous keyboard arrangements, the present invention utilizes the middle region of a horizontally divided keyboard for location of a centered [m×n] array of keys where m and n are integers, m at least 4, representing the number of rows and columns, respectively comprising the array. In one form of the invention, a [5×2], calculator-type numeric keypad obsoletes the [1×10] array of numeric keys common to single cluster arrangements such as the Sholes configuration. The present invention more fully exploits the index finger's capacity for medial movements in accessing an indexed array of keys, in excursion from its Home position in a laterally adjacent key cluster. In addition, access to "accessory" characters, in the uppercase position of the conventional number keys, is facilitated in the present invention without the requirement of a shift to uppercase. Also, the present invention provides regionalization of the keyboard so that Nonletter keys are clustered into functional groupings such as punctuation, bracketting, control, numeric antecedents, numeric successors, numerics, and arithmetic operators. Furthermore, these groupings are placed on the keyboard, in position relative to each other, consistent with the left-to-right order of elements from such groups that is customary in the flow of character data entry. Thus keys for numeric antecedents are located left of those for numerics, which are left of keys for numeric successors; and keys for brackets are located lateral to the keys for the alphanumerics that they commonly enclose.

In a preferred embodiment, a cluster of minimally ten keys, at least ten of which are arranged in two columns of five keys each, is centered in the middle region of a divided data entry keyboard and designated to comprise a Central Numeric Keypad formed by the ten number keys: [1,2,3,4,5,6,7,8,9,0]. The arrangement of number keys in the two columns can be ordered to follow a binary rule separating the numbers in the column one side of the center of the keyboard from those in the column on the other side of center. For example, this rule may be: right-hand high/left-hand low, or, right-hand odd/left-hand even. The ten-key Numeric Insert Keypad can be augmented by keys added between and/or lateral to the two columns of Numeric keys. Further features of the invention will become apparent from the detailed description which follows.

DEFINITION OF TERMS

Figure 1:
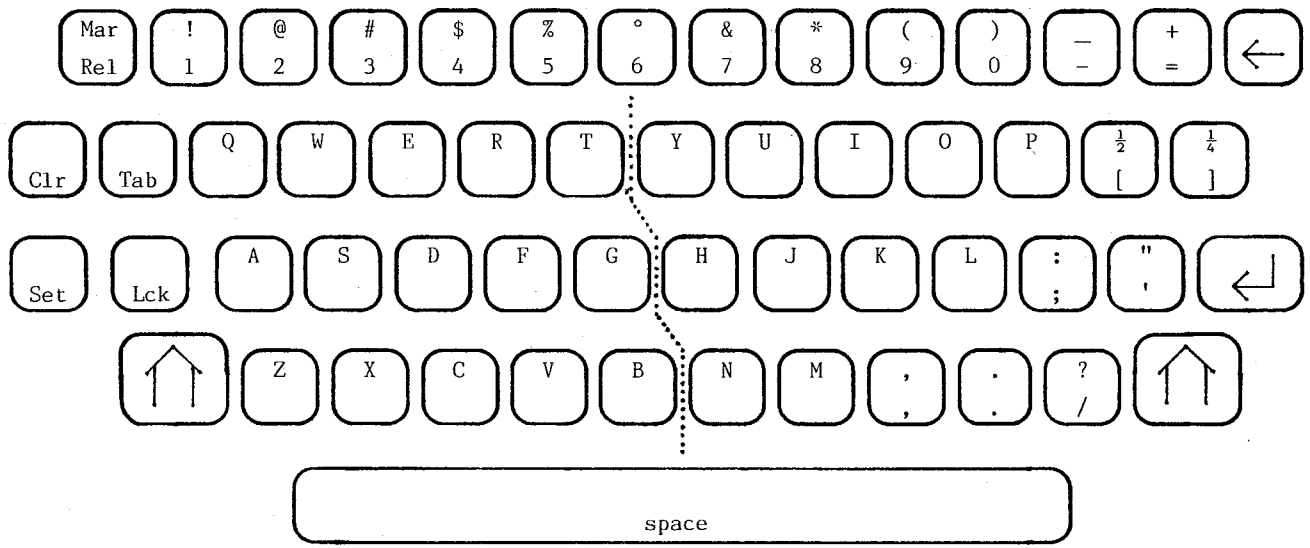
PRIOR ART FIGURE 1
FIG. 1 is a diagrammatic plan view of a conventional keyboard arrangement.
Figure 2A:
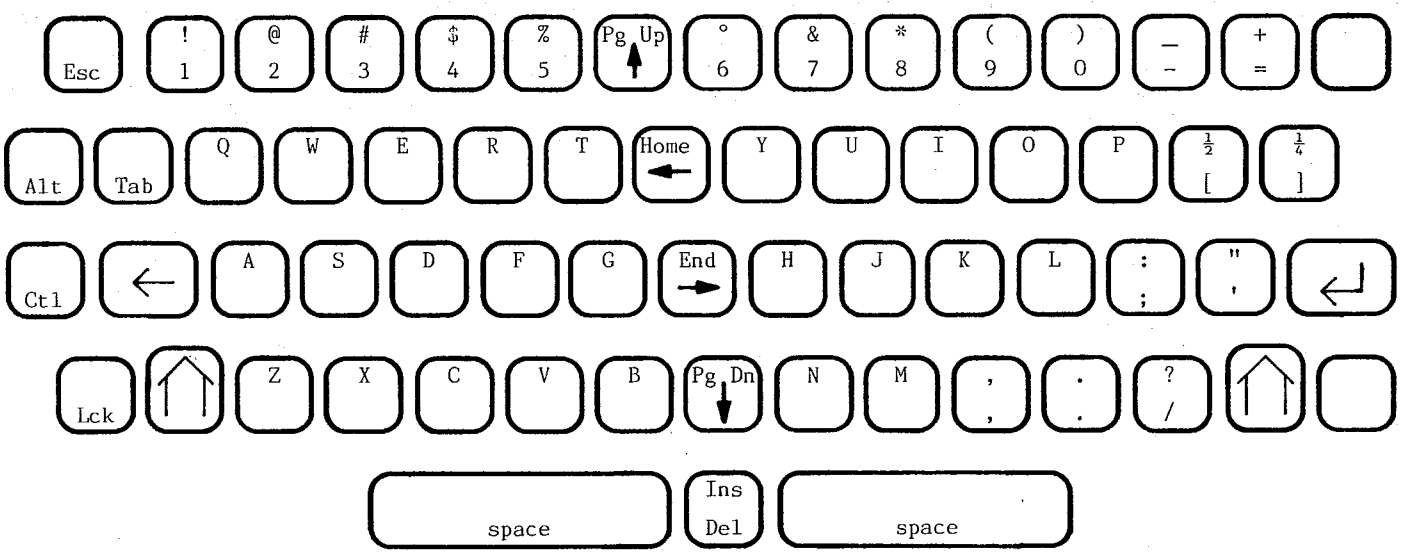
FIG. 2*a* is a diagrammatic plan view of a first embodiment of the data entry keyboard of the present invention wherein the matrix comprises one column of five editing keys.
Figure 2B:
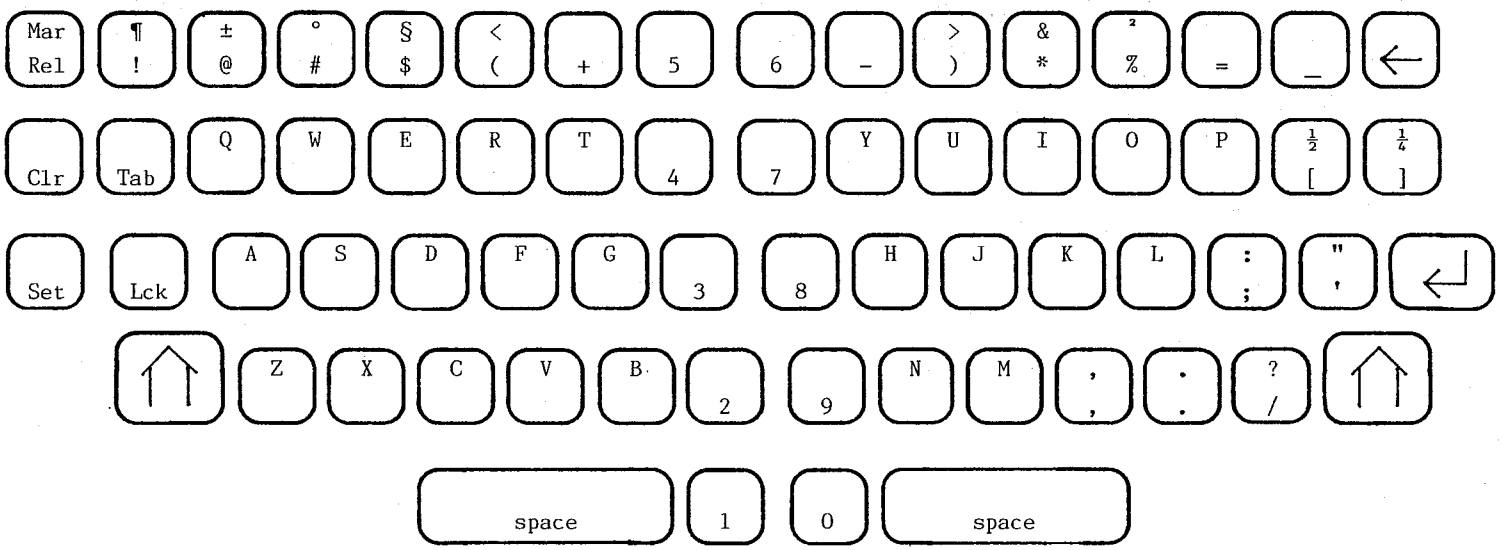
FIG. 2*b* is a diagrammatic plan view of a second embodiment of the data entry keyboard of the present invention wherein the matrix comprises two columns of ten number keys.

Keyboard is a cluster of elemental spaces, called keys, each key acted on by a single digit of the hand to effect, by proximity or pressing, the transmission of the value of such action encoded by prior electromechanical design.

The keyboard is conveived as a 2-dimensional array of keys. Rows, extending from a first, top row, distal to the operator, are numbered increasing from Row 1 to Row 5, which is also the Bottom Row of keys and is most proximal to the keyboard operator. In the conventional keyboard arrangement, the Bottom Row is comprised solely of the Spacebar. Columns of keys extend from the right to left lateral borders of the keyboard and are conventionally aligned in vertically staggered manner.

Individual keys are designated at the surface which contact is made by the operator to input the value of a character. The set of characters conventionally represented on a keyboard may be subdivided into the following types:

Letter or Alphabetic may be one of 26 characters comprising the English language.

Nonletter refers to the set complementary to the set of Letters.

Numeric or Number refers to the set of Arabic characters: 1234567890.

Nonnumeric refers to the set complementary to the set of Numbers.

Numeric-related refers to characters conventionally associated with numbers. The following two terms refer to divisions within the set of Numeric-related characters:

Numeric Precedent refers to characters within the set Numeric-related which commonly precede Numbers, including: # Number Sign, @ At Sign, $ Dollar Sign.

Numeric Successor refers to characters within the set Numeric-related which commonly follow Numbers, including: + Plus Sign, − Minus Sign, % Percent Sign, ½ Half Sign.

Bracket refers to any of the following characters: ( ) Parentheses, [ ] Square Brackets, < > Angle Brackets, { } Braces.

Punctuation refers to any of the following characters: . Period, , Comma, : Colon, ; Semicolon, ! Exclamation Mark, ? Question Mark, ' Apostrophe, " Quotation Marks, / Slash (Virgule).

Numeric Punction refers to any of the following characters: . Decimal Point, , Comma, : Colon, /Slash.

Text characters include: & Ampersand, * Asterisk, _ Underline.

Operators include arithmetic characters: + Add, − Subtract, × Multiply, ÷ Divide, = Equals. (For computer entry, * commonly replaces × for Multiply; and / commonly replaces ÷ for Divide).

Extended set refers to characters not named in the above and includes, but is not limited to: ± Plus or Minus, ° Degrees, ¼ One fourth, ¶ Paragraph Mark, ² Squared Sign, § Section Mark.

Control refers to keyboard actuated signals intended for affecting the system in which the keyboard is a part, beyond the encoding of character data.

Cursor Control refers to keyboard actuated movement of the video display cursor conventionally utilizing 4 keys designated for pointing in four, coplanar, orthogonal directions.

Insert key is used for adding a space in a line of text on a video display screen.

Delete key is used for deleting a space in a line of text on a video display screen.

Staggered refers to the nonvertical alignment of keys in adjacent rows.

Right-hand Cluster in a keyboard, divided horizontally into approximately equal groupings of keys, is the right-hand grouping.

Left-hand Cluster in a keyboard, divided horizontally into approximately equal groupings of keys, is the left-hand grouping.

Home

A. on the video display screen, the Home position of the cursor is the upper left corner of the screen.

B. on the Keyboard, the Home Row is the middle row of keys which contains the 8 keys on which the fingers of the hands rest prior to and after the performance of a keystroke.

Numeric Insert is a term used to describe the invention in the form of minimally a [5×2] array of number keys which, applied, may be referred to as a Numeric Keypad. Because of the location of the Keypad in the middle of a divided Cluster of keys, reference may also be made to a Central Numeric Insert, or Central Numeric Keypad. The numbers may be decimal, hexadecimal, etc. If the Numeric Insert is accompanied by other Non-Letter keys, it is termed an Augmented Numeric Insert, one being more specifically termed an Edito-Numeric Insert.

DESCRIPTION OF THE PREFERRED EMBODIMENTS

FIG. 1 depicts a conventional keyboard arrangement, including Sholes' QWERTY configuration ("QWERTY cluster"), so named by the order of keys in the top row of letter keys beginning from the leftmost key in the alphabetic cluster. In the top row of the keyboard is found the [1×10] array of number keys, which set, associated with the QWERTY cluster, comprises the conventional standard existent since Sholes' invention. Keys peripheral to the QWERTY cluster vary in designation among different keyboard manufacturers. FIG. 1 approximates the arrangement typical of an IBM Selectric typewriter.

In addition to the 26 letter keys, there are in the QWERTY cluster four keys designated for encoding punctuation, completing a set of 30 keys arranged in a staggered [3×10] array (QWERTY thirty). It is usual practice for each hand to service 15 keys, such that the index finger services the two most medial columns while the other fingers each service one column of keys. It is for the little finger to reach laterally in accessing keys outside of the QWERTY thirty.

The dotted line in FIG. 1 indicates the line of bisection applied to the three-row cluster of the QWERTY thirty. The present invention entails an expansion of the zero horizontal dimension of the dotted line, and extension of its vertical dimension into the top and bottom rows.

A minimal form of the present invention is depicted in FIG. *2a*. A [5×1] columnar array of editing keys is located medially between the halves of the divided cluster of FIG. 1, aligned in conformance with the margins of the adjacent keys of the divided cluster. The [Ins/Del] key is vertically aligned with the key adjacent above and divides the symmetrically separated spacebar. Some peripheral keys have been altered to reflect the use of this arrangement in control of a video display terminal.

In FIG. *2b*, a [5×2] array of number keys is horizontally centered in the region of the expanded dotted line of FIG. 1. Vertically, the array includes two keys in the bottom row, or Row 5, and two keys in the top row (Row 1). The elongated single spacebar of the conventional arrangement has been abbreviated and divided symmetrically to accommodate keys for the [1] and [0]. Generally, these two are the most frequently entered numerals, and in this arrangement, can readily be entered by short medial movements of the thumbs. The remaining eight number keys are readily accessed by medial excursion of the index fingers and the ten numeric keys are so ordered as to follow a binary rule of separation, i.e. left side—low [1,2,3,4,5]/right side—high [6,7,8,9,0]; and further, ordered clockwise beginning with [1] at about the seven o'clock position. It will also be understood that other numbering systems may also be represented, for example the hexadecimal numbers: 1 2 3 4 5 6 7 8 and 9 A B C D E F O.

The staggering of vertical alignment that is apparent in the four upper rows of FIG. 1 and FIG. *2a* has been maintained in only the three middle rows in the invented rearrangement of FIG. *2b*. The top and bottom rows are each aligned vertically with the respective adjacent row. Top row keys no longer encode for numbers but provide entry of accessory characters which previously required the simultaneous depression of a Shift key. FIG. *2b* shows a rearrangement of these accessory keys providing location of arithmetic operator keys, [+] and [−], adjacent to the top row keys of the Central Numeric Keypad. Next lateral to these operator keys are the Parentheses keys, symmetrically accessed by the respective index finger. Lateral to the Right Parenthesis key is a sequence of keys for Asterisk/Ampersand, Percent Sign/Squared Sign, Equal Sign, Underline, and Backspace. Keys lateral to the Left Parenthesis are as found in the uppercase position of the corresponding key in the conventional keyboard. Additional characters occupy the new uppercase positions. While FIG. *2b* depicts several possible characters which may be entered by pressing these keys in combination with a Shift key, preferably what is encoded by such action may be selected programmatically from a larger set of characters supported by electronic design of the system in which the keyboard functions.

Figure 3:
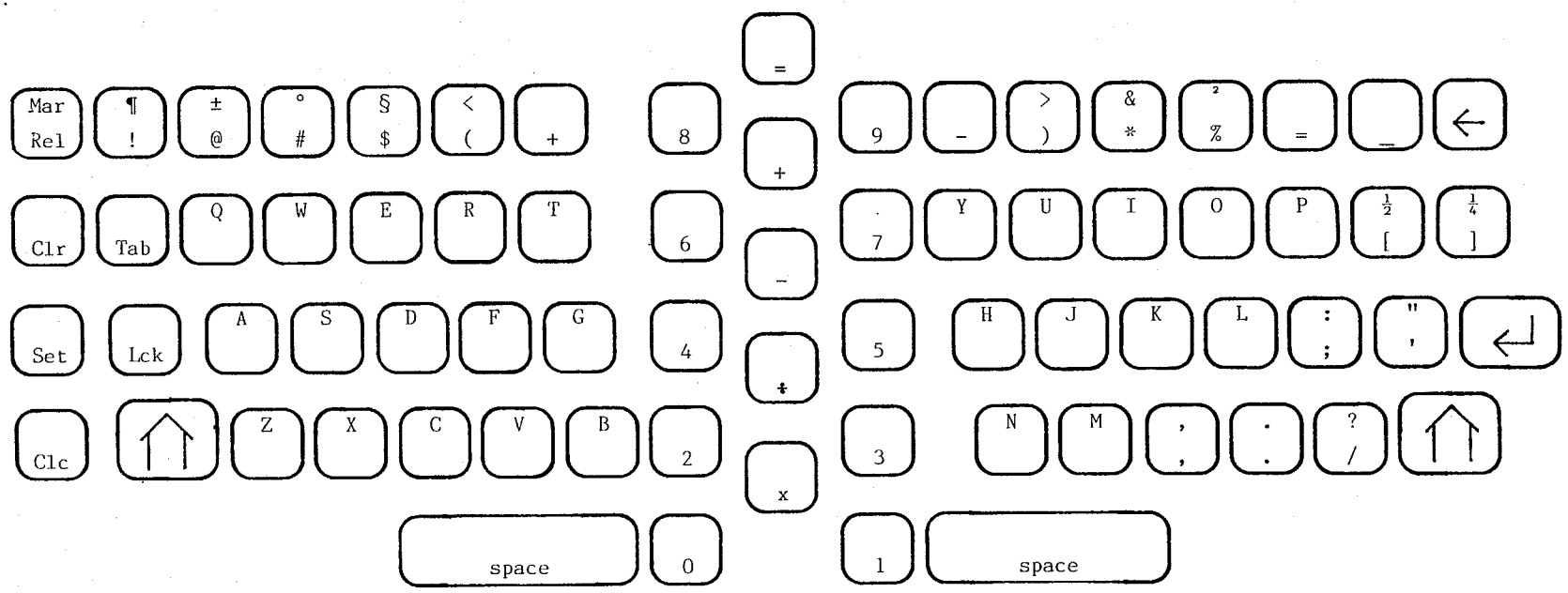
FIG. 3 is a diagrammatic plan view of a third embodiment of the data entry keyboard of the present invention wherein the matrix comprises three columns of fifteen arithmetic calculator-type keys.

In FIG. 3 a Central Numeric Insert is vertically aligned and augmented by a central column of five additional keys which may enable the implementation of an arithmetic calculator when supported by underlying electronic design. Calculator entry may be selected by a key peripheral to the cluster depicted in FIG. 3, as in a new top row—Row O (not shown)—or by simultaneous depression of a Shift key and a key such as the Equals Sign in the central column. It will be especially observed that in both FIG. *2b* and FIG. 3 the arrangement of letter keys lateral to the dotted line of FIG. 1 is not necessarily affected by the present invention.

Figure 4:
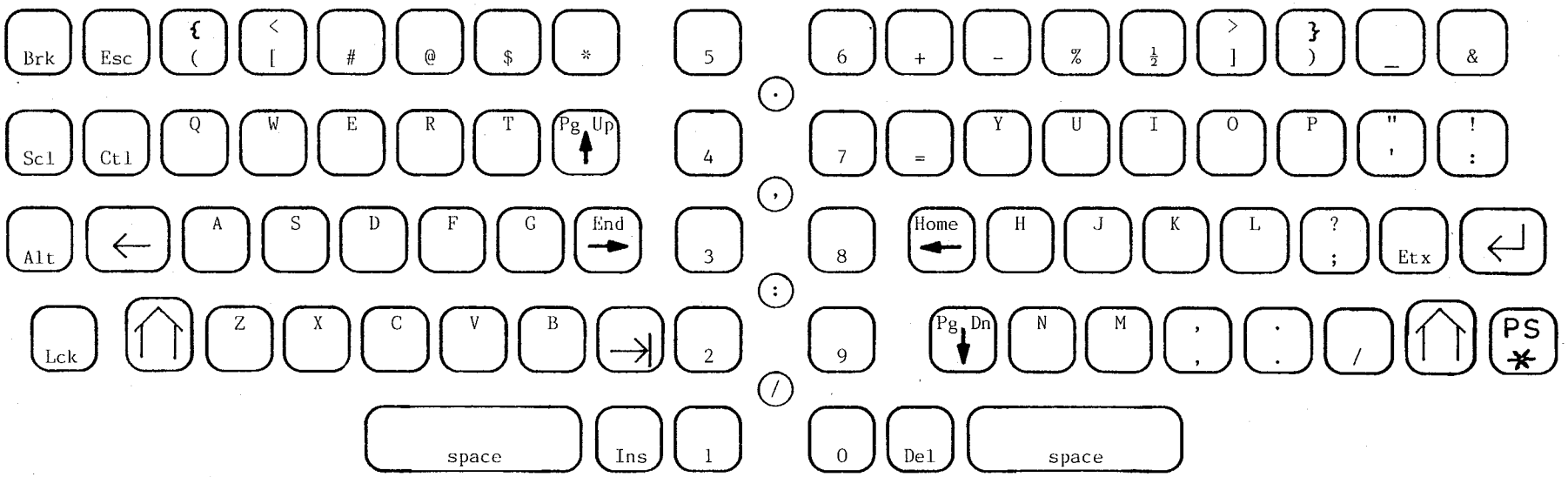
FIG. 4 is a diagrammatic plan view of a fourth embodiment of the data entry keyboard of the present invention wherein the matrix comprises five columns of twenty-four edito-numeric keys.

FIG. 4 depicts the invention as a keyboard arrangement suitable for use at the human interface to a character data processor, which system includes equipment to display character data subject to control by input from the keyboard. In this arrangement, a [5×2] array of numeric keys is centered and aligned vertically within the middle region of the divided Sholes cluster. This numeric arrangement enables entry of ones and zeros by the thumbs. The numbers are arranged increasing clockwise counting from the [1] key in the about the seven o'clock position. Access to numeric keys is left-hand for low numbers [1,2,3,4,5]/right-hand for high [6,7,8,9,0] numbers in two-handed keyboard operation.

Centered between the columns of number keys is a vertical column of four keys for numeric-related punctuation arranged from top to bottom in the sequence [. , : /].

The staggered row alignment of Sholes' configuration is preserved in the 3 middle rows which include the Letter keys. The top and bottom rows of keys are each aligned vertically with keys in the respective adjacent row.

The bottom row consists of two horizontally separated Spacebars; Insert and Delete keys are located in the space between the Spacebars and the Bottom Row keys of the Central Numeric Keypad. Keys in this row are readily served by the thumbs.

Keys in the top row are arranged in functional linear clusters within the [1×18] array:

(1) outermost 4 keys: control keys and text characters: left side: operating system control functions: Break and Escape right side: text characters for Underline and Ampersand (2) next inner 4 keys: four common bracketting character schemes: The little fingers symmetrically access the Parentheses, which keys depressed in conjunction with a Shift key encode for the Braces. The ring fingers readily access the Square Brackets, which keys depressed in conjunction with a Shift key encode for the Angle Brackets (also construed as the symbols, Less Than and Greater Than).

(3) next medial 6 Nonnumeric keys: Numeric-related characters: left side: common Numeric Precedents: Number Sign, At Sign, and Dollar Sign right side: common Numeric Successors: Half Sign, Percent Sign, and Minus Sign (4) most medial Nonnumeric keys: common Numeric Operators: left side: Asterisk (commonly the Multiply Sign) right side: Plus Sign.

Except for the two Numeric keys and four Bracketting keys, in combination with a Shift key, the top row keys encode for characters from an extended set, limited by the system in which the keyboard operates. In the preferred embodiment, the combination accesses a character selected from a set of extended ASCII-encoded characters and functions by a prior operation on the keyboard involving programming the key to one of 255 codes supported by the system.

Depression of a Numeric key in conjunction with a Shift key encodes for starting a programmable system function. For example, ten Numeric keys can provide up to ten functions, indexed numerically.

Entry of numbers is served by the index fingers and thumbs while maintaining the hands in the Home position on the QWERTY cluster, or by a single digit, naturally the index finger of the favored hand, the Numeric keys being equally accessible from the right or left, in excursion from the Home position. During single digit number entry, common numeric punctuation marks are readily accessible at the center of the keyboard.

To facilitate no-look return of the operator's hands to the Home position, the keys for F and J have aspects of designation (for example, raised letters) distinguishing the feel of these keytops from other keys not found in the eight Home Row keys [A,S,D,F, J,K,L,;] of Sholes' keyboard arrangement.

Keys for positioning the cursor on the screen are located in the middle three rows, adjacent to the keys comprising the medial columns of the divided QWERTY cluster, as shown in FIG. 4.

Because of the staggering of row alignment in the QWERTY cluster, space is provided in the upper left and lower right margins of the central numeric keypad. These spaces serve the functions of delimiting the central numeric keypad and providing relief from the strain of visual congestion.

Following the recommendation by Emmons et al. in IBM Tecnical Disclosure Bulletin Vol. 22 No. 11, April 1980, the Backspace key is located lateral to the leftmost Letter key in the middle row of the keyboard. The area of the key is horizontally extended laterally so the left margin of the key aligns with the left margin of the key above it, namely the Control key.

The Backspace key is next to the key for Alternate Encoding, [Alt], which is aligned with and inferior to the key for Scroll lock, [Scl]. Between the Scroll lock key and the leftmost Letter key of the top alphabetic row is located the Control key.

The Shift keys are located laterally adjacent to the Bottom Row Letter keys of the QWERTY cluster. The area of each Shift key is extended vertically, upwardly. Lateral to the left Shift key is a key to Lock the shift for uppercase alphabetic entry. Lateral to the right Shift key is a redundant key for Asterisk in the lower case; in combination with a Shift key, this key encodes for the function Print Screen.

Punctuation marks are clustered on the right lateral aspect of the keyboard. Conventional arrangement applies to the location of the Semicolon key under the right little finger in the Home position, and a key for the Slash beneath the Semicolon key. In departure from the conventional, the Shift combination with the Semicolon key encodes for the Question Mark, while the Shift combination with the Slash key is programmable.

The key for Apostrophe—Quotation Marks in conjunction with a Shift key—is located adjacent to the rightmost Letter key of the top alphabetic row. Laterally adjacent is the Colon key, which enters the Exclamation Mark in the upper case.

Laterally adjacent to the Semicolon key is the Editor Accept key labeled ETX in FIG. 4. The upper case for this key is programmable. Next lateral to this key is the key for Line Feed/Carriage Return/Enter, which key area is also dimensionally extended laterally.

The effect of the arrangement of the keyboard in FIG. 4 is to subdivide the entry character set into logical clusters of keys, facilitating early, trained movements in the general direction of the intended key before the brain has specifically mapped the finger motion to the key of choice.

Numeric-related symbols are grouped proximally to the Central Numeric Keypad and no longer require the Shift key combination for entry.

Each hand may access up to ten programmable characters/functions when pressing Non-alphanumeric keys while a Shift key is depressed. Additionally, the Numeric keys may activate ten different preprogrammed functions when pressed in conjunction with a Shift key.

In cursor control, desired changes in the location of the cursor on the XY plane of the screen are readily accomplished by motions of the index finger in the direction over the keyboard equivalent to the direction of desired motion on the screen. The function selection associated with these keys, depressed in conjunction with a Shift key, is logically aligned to the direction designated on the vector key which enters the function. In the following the function appears last in each line:

To move cursor up: L index finger moves up; Page Up.

To move cursor right: L index finger moves right; End.

To move cursor left: R index finger moves left; Home.

To move cursor down: R index finger moves down; Page Down.

To tab cursor right: L index finger moves right; Tab Right.

Insert and Delete keys are located for ready access by the thumbs while fingers maintain Home Row position. Space is available lateral to the Spacebars for locations of keys additional to the number shown in FIG. 4.

The arrangement of FIG. 4 allows for an additional top row of keys, Row 0 (not shown), for activation of other special functions not discussed in the above description.

Figure 5:
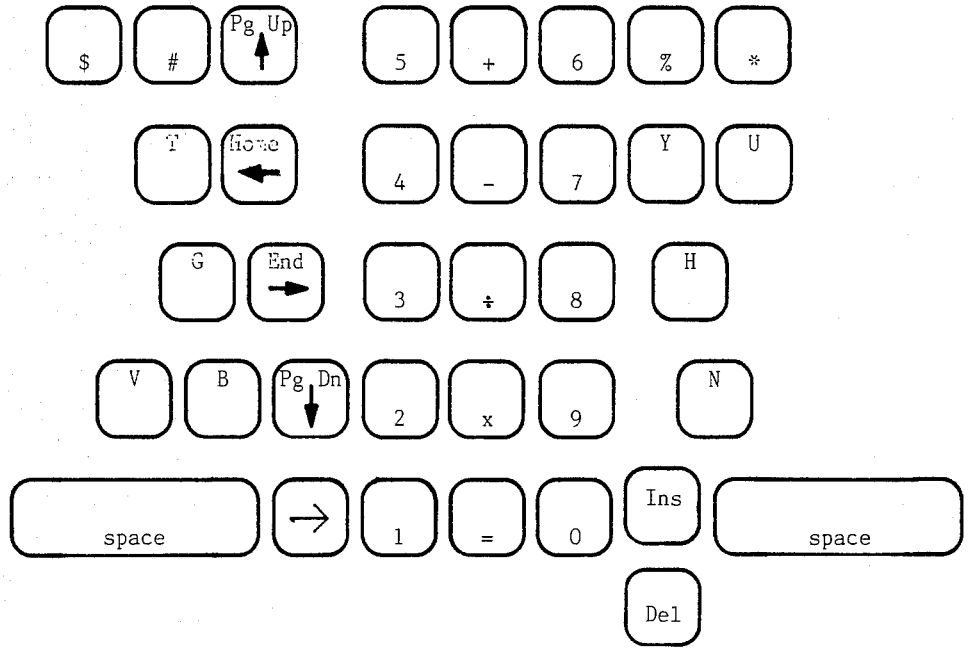
FIG. 5 is a fragmentary diagrammatic plan view of a portion of a fifth embodiment of the data entry keyboard of the present invention wherein the matrix comprises five columns of twenty-two keys partitioned into three groups: one column of five cursor control keys, three columns of five arithmetic calculator-type keys, and one column of two editing keys.
Figure 6:
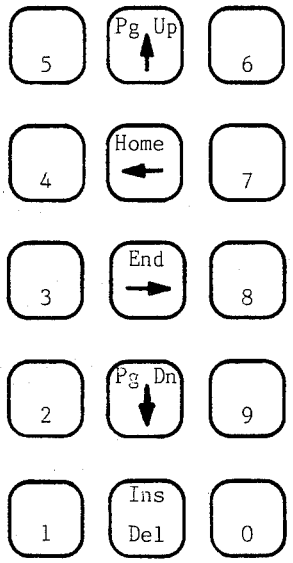
FIG. 6 is a diagrammatic plan view of an alternate arrangement for the matrix.
Figure 7:
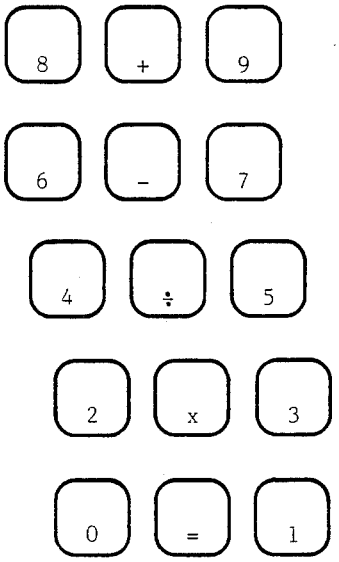
FIG. 7 is a diagrammatic plan view of another alternate arrangement for the matrix.

FIGS. 5, 6, and 7 illustrate modifications to a portion of the keyboard arrangement of FIG. 4. In FIG. 5, the Numeric Insert has been augmented by a central column of five arithmetic operator keys which may serve to implement the function of an arithmetic calculator, such as described above for FIG. 3. The Augmented Numeric Insert is here arranged for service by only the right index finger and thumb (controlled by the more numerically-oriented Left Brain) in short medial excursion from the Home position.

Medially adjacent to the left hand cluster of the divided QWERTY cluster, is a staggered column of five cursor control keys which in FIG. 4 were located on both sides of the Central Numeric Insert. Each key offers dual function with the shift combination as discussed above. Here, cursor movement functions are serviced by the left index finger (controlled by the more spatially-oriented Right Brain). The Tab key is readily accessed by the left thumb while the Insert and Delete keys are positioned for ready access by the right thumb. In another variation not shown, the functions of these latter two keys in FIG. 5 may be integrated into one key, as in FIG. 6, horizontally aligned with the bottom row of the Numeric Insert.

FIG. 6 and FIG. 7 show two of many variations representing augmentations of the [5×2] Numeric Insert Keypad. FIG. 6 shows an Edito-Numeric Insert applicable to a keyboard from which control of a computer video display terminal is manually implemented. FIG. 7 illustrates a Central Numeric Insert, augmented by a central column of calculator function keys, the middle three rows being staggered to conform to the margins of the divided QWERTY cluster. It will be understood that the Augmented Numeric Keypad arrangements illustrated in FIGS. 6 and 7 are exemplary only, and may be modified within the principle and scope of the present invention to provide columns of keys, additional to the [5×2] numeric array, that serve other functions than the three discussed herein, namely, edit, calculator, and numeric punctuation.

The preceding discussion relates to keyboard arrangements wherein the designations of keytypes are generally fixed, at least in the lowercase. The keyboard arrangements so described may also be useful in cases wherein the value of encoding for each key is user selectable. Thus, all keys in the central matrix of keys may be user selectable, or all keys in the keyboard might be user selectable depending on the underlying electronic design of the keyboard.

I claim:

1. A two-handed, manually actuable, character data input keyboard arrangement having a plurality of letter and accessory keys, wherein each of said letter keys represents one letter of an alphabet, the complete set of said letter keys arranged to comprise two substantially regular arrays of complementary subsets of said set, said two arrays including all of the letters of said alphabet and other keys, said other keys comprising accessory keys, each of said arrays having three substantially straight substantially horizontal rows, said rows being substantially evenly spaced and substantially parallel, and each of said arrays having also five columns, said columns being substantially evenly spaced and substantially parallel;

each of said arrays primarily augmented by at least one row of one or more accessory keys, said last-mentioned row substantially parallel to, and adjacently beneath, the bottommost row of the respective array, each of said primarily-augmented arrays secondarily augmented by one or more columns of keys, located lateral and adjacent to the lateralmost column of the respective primarily augmented array, each of said secondarily-augmented arrays thirdly augmented by at least one row of accessory keys, said last-mentioned row substantially parallel to, and adjacently above, the topmost row of the respective secondarily-augmented array, and each of said thirdly augmented arrays, defining clusters, spaced horizontally apart from each other and separated by a matrix of keys comprising at least one column of keys including at least four keys therein, wherein the bottommost row of said matrix is readily accessible by the thumbs from their home positions on the bottommost row of said primarily-augmented arrays, and such that the remaining rows of keys in said matrix are readily accessible by the index fingers from their home positions in the middle rows of said arrays.

2. The keyboard arrangement according to claim 1 wherein said arrays are ordered from the left as follows:

(a) left array:
  (1) top row: Q, W, E, R and T
  (2) middle row: A, S, D, F and G
  (3) bottom row: Z, X, C, V and B (b) right array:
  (1) top row: Y, U, I, O and P
  (2) middle row: H, J, K, L and an accessory key
  (3) bottom row: N, M and three accessory keys.

3. The keyboard arrangement according to claim 1 wherein said arrays are ordered from the left as follows:

(a) left array:
  (1) top row: three accessory keys, P and Y
  (2) middle row: A, O, E, U and I
  (3) bottom row: accessory key, Q, J, K and X (b) right array:
  (1) top row: F, G, C, R and L
  (2) middle row: D, H, T, N and S
  (3) bottom row: B, M, W, V and Z.

4. The keyboard arrangement according to claim 1 wherein said matrix includes editing keys.

5. The keyboard arrangement according to claim 1 wherein said at least four keys in said matrix column serve the function of cursor positional control, each said key operating so as to move the cursor in one of four, coplanar, orthogonal directions.

6. The keyboard arrangement according to claim 1 wherein one of the keys in said matrix select-ably serves both the functions of insert and delete.

7. The keyboard arrangement according to claim 1 wherein two of the keys in said matrix serve the functions of insert and delete.

8. The keyboard arrangement of claim 5 wherein said four keys are selectively also operable to serve the functions: Page Up, Home, End, and Page Down, the four said keys being thereby designated to indicate: cursor-up/Page Up, cursor-left/Home, cursor-right/End, cursor-down/Page Down.

9. The keyboard arrangement according to claim 5 wherein said cursor positional control keys are arranged so that the topmost key is operable to move the cursor up and the bottommost key is operable to move the cursor down.

10. The keyboard arrangement of claim 1, said matrix including a tab key.

11. The keyboard arrangement of claim 1, said matrix including one or more arithmetic operator keys.

12. The keyboard arrangement of claim 11 wherein said arithmetic operator keys are selected from the set consisting of the + − × ÷ = / * keys.

13. The keyboard arrangement of claim 1, said matrix including at least one key for punctuation.

14. The keyboard arrangement of claim 1, said matrix including number keys.

15. The keyboard arrangement of claim 14 wherein said number keys represent the set of hexadecimal numbers.

16. The keyboard arrangement of claim 14 wherein said number keys are arranged such that the keys for 0 and 1 are readily accessible by the thumbs.

17. The keyboard arrangement of claim 14 wherein said number keys represent the set of decimal numbers.

18. The keyboard arrangement of claim 17, wherein the said set of number keys is arranged in two columns such that the left hand column of keys is comprised of the set 1 2 3 4 5, in the order listed from the bottom row; and the right hand column of keys is comprised of the set 6 7 8 9 0, in the order listed from the top row.

19. The keyboard arrangement of claim 1 wherein said matrix comprise number keys arranged in two columns.

20. The keyboard arrangement of claim 19 wherein said number keys are arranged such that numbers in the left-hand column of said two columns increase upwardly from the bottom of the column, and numbers in the right-hand column increase downwardly from the top of the column.

21. The keyboard arrangement of claim 19 wherein the keys in one of said columns represent even numbers and the keys in the other of said columns represent odd numbers.

22. The keyboard arrangement of claim 19 wherein the keys in one of said columns represent the lower number keys, and the keys in the other of said columns represent the higher number keys.

23. The keyboard arrangement of claim 1 wherein at least one of the keys in said matrix selectively has at least two functions.

24. The keyboard arrangement of claim 23 wherein at least one of said two functions is user select-able.

25. The keyboard arrangement of claim 1 wherein the keys in said at least one row of said thirdly augmented arrays are aligned with a row of keys in said matrix and are grouped in linear sequences of functionally related keys comprising the accessory keys: numeric precedents, numerics, numeric successors, and bracket characters; said linear sequences being positioned according to the usual order of entry of characters from these sequences in the stream of alphanumeric data, such that the numeric precedent keys are located to the left of the numeric keys, and the numeric keys are located to the left of the numeric successor keys, bracket character keys being positioned symmetrically and laterally to said numeric precedent and successor keys.

26. The keyboard arrangement of claim 1 wherein at least one of said accessory keys, that is not a matrix key, has at least two functions, at least one of said functions being user selectable.

27. The keyboard arrangement of claim 1 wherein all keys for punctuation marks, that are located in said clusters, are grouped in the right-hand portion of said right-hand cluster.

28. The keyboard arrangement of claim 1 wherein said matrix consists of at least two columns of keys arranged in rows, said last-mentioned columns being perpendicular to said last-mentioned rows.

29. The keyboard arrangement of claim 1 wherein at least two of the accessory keys in said at least one row of said thirdly augmented arrays are bracket keys, so positioned as to be symmetrically accessible by the same finger of each hand.

30. The keyboard arrangement of claim 1 wherein said matrix includes a plurality of groups of functionally related keys.

31. The keyboard arrangement of claim 1 wherein at least one of the keys of said matrix is reduced in the amount of keytop area, relative to other keys in said arrangement.

32. The keyboard arrangement of claim 1 wherein said keyboard keys, other than those in said arrays, are grouped into linear sequences of keys, said sequences ordered with respect to one another, said keys defining sequence members.

33. The keyboard arrangement of claim 32 wherein said linear sequences are arranged from left to right on said keyboard to reflect the order of appearance of characters corresponding to said keys in the usual stream of input data.

34. The keyboard arrangement of claim 32 wherein the order of keys within a sequence is determined by the rule that more frequently used keys be located nearer the medial boundaries of said arrays with respect to the keyboard.

35. The keyboard arrangement of claim 1 wherein the arrangement of keys in said matrix, and the arrangement of said accessory keys that are not in said arrays, is determined, in each row, by the rule that more frequently used keys be nearer the medial boundaries of said arrays with respect to the keyboard.

* * * * *